US007637689B2

(12) United States Patent
Boxall et al.

(10) Patent No.: US 7,637,689 B2
(45) Date of Patent: Dec. 29, 2009

(54) ON-GRADE PLATES FOR JOINTS BETWEEN ON-GRADE CONCRETE SLABS

(76) Inventors: Russell Boxall, 435 S. Tyron St., #805, Charlotte, NC (US) 28202; Nigel Parkes, 8945 Ridgemont Dr., Atlanta, GA (US) 30350

( * ) Notice: Subject to any disclaimer, the term of this patent is extended or adjusted under 35 U.S.C. 154(b) by 209 days.

(21) Appl. No.: 11/464,058

(22) Filed: Aug. 11, 2006

(65) Prior Publication Data

US 2007/0059096 A1 Mar. 15, 2007

Related U.S. Application Data

(60) Provisional application No. 60/707,353, filed on Aug. 11, 2005.

(51) Int. Cl.

| | |
|---|---|
| ***E01C 11/02*** | (2006.01) |
| ***E01C 11/06*** | (2006.01) |
| ***E01C 11/08*** | (2006.01) |
| ***E01C 11/16*** | (2006.01) |

(52) U.S. Cl. ..... 404/53; 404/47; 404/51; 404/74

(58) Field of Classification Search ..... 404/47–74
See application file for complete search history.

(56) References Cited

U.S. PATENT DOCUMENTS

| | | | | |
|---|---|---|---|---|
| 714,971 | A | 12/1902 | Thacher | |
| 811,560 | A | 2/1906 | Hinchman | |
| 828,550 | A | 8/1906 | Inman | |
| 881,762 | A | 3/1908 | Adreon, Jr. | |
| 1,092,734 | A | 4/1914 | McLoughlin | |
| 1,604,992 | A * | 11/1926 | Gregg et al. | 404/53 |
| 2,103,337 | A | 12/1937 | Oury | |

(Continued)

FOREIGN PATENT DOCUMENTS

| | | |
|---|---|---|
| EP | 0059171 | 9/1982 |
| WO | 99 31329 A | 6/1999 |

OTHER PUBLICATIONS

Ralph E. Spears, Concrete Floors on Ground, 1983, pp. 16-25, Second Edition, Portland Cement Association, USA.

(Continued)

*Primary Examiner*—Raymond W Addie
(74) *Attorney, Agent, or Firm*—Banner & Witcoff, Ltd.

(57) ABSTRACT

Embodiments of the invention relate to an on-grade joint-stability system for on-grade concrete slabs. Embodiments of the system may include: a first on-grade concrete-slab portion; a second on-grade concrete-slab portion that is separated from the first on-grade concrete-slab portion by a joint; a first on-grade plate having a first portion and a second portion, the first portion of the first on-grade plate being positioned underneath, and connected to, the first concrete-slab portion, and the second portion of the first on-grade plate being positioned underneath the second concrete-slab portion; and a second on-grade plate having a first portion and a second portion, the first portion of the second on-grade plate being positioned underneath the first concrete-slab portion, and the second portion of the second on-grade plate being positioned underneath, and connected to, the second concrete-slab portion, such that height differentials across the joint are substantially prevented.

20 Claims, 6 Drawing Sheets

U.S. PATENT DOCUMENTS

| | | | | | |
|---|---|---|---|---|---|
| 2,121,303 | A | | 6/1938 | Robertson | |
| 2,308,677 | A | | 1/1943 | Dailey | |
| 2,349,983 | A | * | 5/1944 | Musall | 404/56 |
| 3,430,406 | A | | 3/1969 | Weber | |
| 3,434,263 | A | | 3/1969 | Beckman | |
| 3,559,541 | A | | 2/1971 | Watstein | |
| 3,561,185 | A | | 2/1971 | Finsterwalder | |
| 3,972,640 | A | * | 8/1976 | Miller | 404/62 |
| 4,531,564 | A | | 7/1985 | Hanna | |
| 4,733,513 | A | | 3/1988 | Schrader | |
| 5,005,331 | A | | 4/1991 | Shaw | |
| 5,216,862 | A | | 6/1993 | Shaw | |
| 5,419,965 | A | | 5/1995 | Hampson | |
| 5,458,433 | A | | 10/1995 | Stastny | |
| 5,487,249 | A | | 1/1996 | Shaw | |
| 5,640,821 | A | | 6/1997 | Koch | |
| 5,674,028 | A | | 10/1997 | Norin | |
| 5,730,544 | A | | 3/1998 | Dils | |
| 6,145,262 | A | | 11/2000 | Schrader | |
| 6,195,956 | B1 | | 3/2001 | Reyneveld | |
| 6,354,760 | B1 | | 3/2002 | Boxall | |
| 7,228,666 | B2 | * | 6/2007 | Michiels | 52/396.05 |

OTHER PUBLICATIONS

Design and Construction of Joints for Concrete Highways, Concrete Paving, 1991, pp. 1-17, American Concrete Pavement Association, USA.

Design and Construction of Joints for Concrete Streets, Concrete Information, 1992, pp. 1-11, American Concrete Pavement Association, USA.

Guide for Concrete Floor and Slab Construction, ACI Committee 302, 1997, pp. 302.1R-6-302.1R-22, American Concrete Institute, USA.

Laser Form pamphlet entitled: Who's going to use Laser Form first? You or your competition?.

Laser Form brochure entitled: Who's going to use Laser Form first? You or your competition?.

* cited by examiner

Figure 1
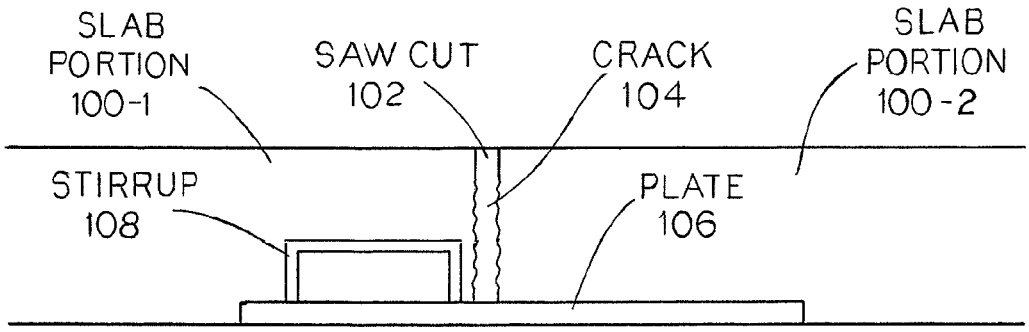
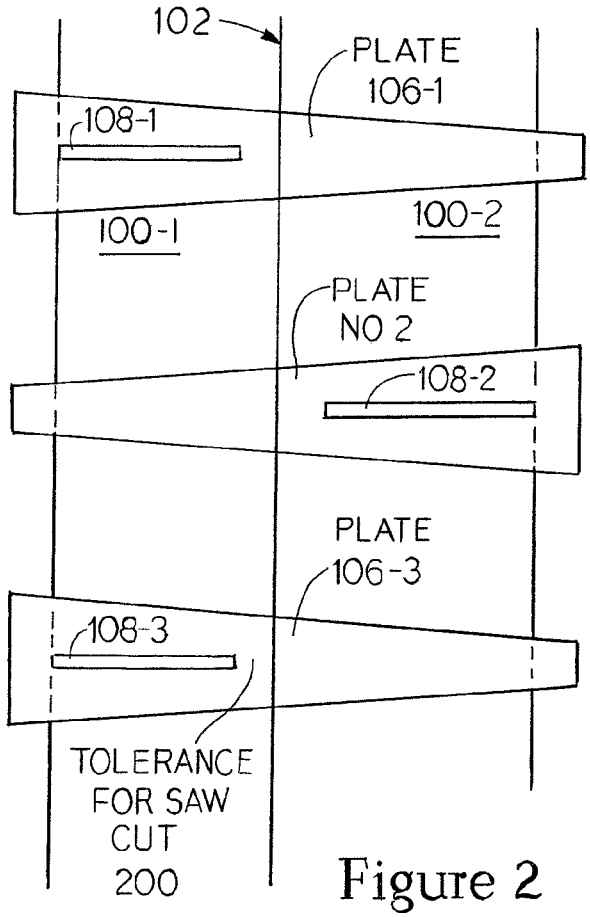
Figure 2

ON-GRADE PLATES FOR JOINTS BETWEEN ON-GRADE CONCRETE SLABS

CROSS REFERENCE TO RELATED APPLICATIONS

This application claims the benefit of U.S. Provisional Application No. 60/707,353, which was filed Aug. 11, 2005, and which is incorporated herein by reference. This application also claims the benefit of U.S. patent application Ser. No. 10/489,380, now U.S. Pat. No. 7,481,031, which was filed Sep. 13, 2002, which is incorporated herein by reference, and U.S. Provisional Application No. 60/318,838, which was filed on Sep. 13, 2001, which is incorporated herein by reference.

BACKGROUND

U.S. Pat. No. 6,354,760, which is entitled System for Transferring Loads Between Cast-in-Place Slabs and issued Mar. 12, 2002, to Russell Boxall and Nigel Parkes, discloses a load plate for transferring loads between a first cast-in-place slab and a second cast-in-place slab separated by a joint. The load plate has at least one substantially tapered end adapted to protrude into and engage the first slab. The load plate is adapted to transfer between the first and second slabs a load directed substantially perpendicular to the intended upper surface of the first slab.

PCT application WO 03/023146 A1, which was published Mar. 20, 2003, is entitled Load Transfer Plate for in Situ Concrete Slabs, and for which Russell Boxall and Nigel Parkes are applicants and inventors, discloses a tapered load plate that transfers loads across a joint between adjacent concrete floor slabs. The tapered load plate accommodates differential shrinkage of cast-in-place concrete slabs. When adjacent slabs move away from each other, the narrow end of the tapered load plates moves out of the void that it created in the slab thus allowing the slabs to move relative to one another in a direction parallel to the joint. Tapered load plates may be assembled into a load-plate basket with the direction of the taper alternating from one tapered load plate to the next to account for off-center saw cuts.

BRIEF SUMMARY

This Brief Summary is provided to introduce a selection of concepts in a simplified form that are further described below in the Detailed Description. This Brief Summary is not intended to identify key features or essential features of the claimed subject matter, nor is it intended to be used as an aid in determining the scope of the claimed subject matter.

Embodiments of the invention relate to an on-grade joint-stability system for on-grade concrete slabs. Such a system may include: a first on-grade concrete-slab portion; a second on-grade concrete-slab portion that is separated from the first on-grade concrete-slab portion by a joint; a first on-grade plate having a first portion and a second portion, the first portion of the first on-grade plate being positioned underneath, and connected to, the first concrete-slab portion, and the second portion of the first on-grade plate being positioned underneath the second concrete-slab portion; and a second on-grade plate having a first portion and a second portion, the first portion of the second on-grade plate being positioned underneath the first concrete-slab portion, and the second portion of the second on-grade plate being positioned underneath, and connected to, the second concrete-slab portion, such that height differentials across the joint are substantially prevented.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein:

FIG. 1 is a side view of an on-grade joint-stability system for on-grade concrete slabs in accordance with embodiments of the invention.

FIG. 2 is a top view of the system of FIG. 1.

DETAILED DESCRIPTION

Figure 3:
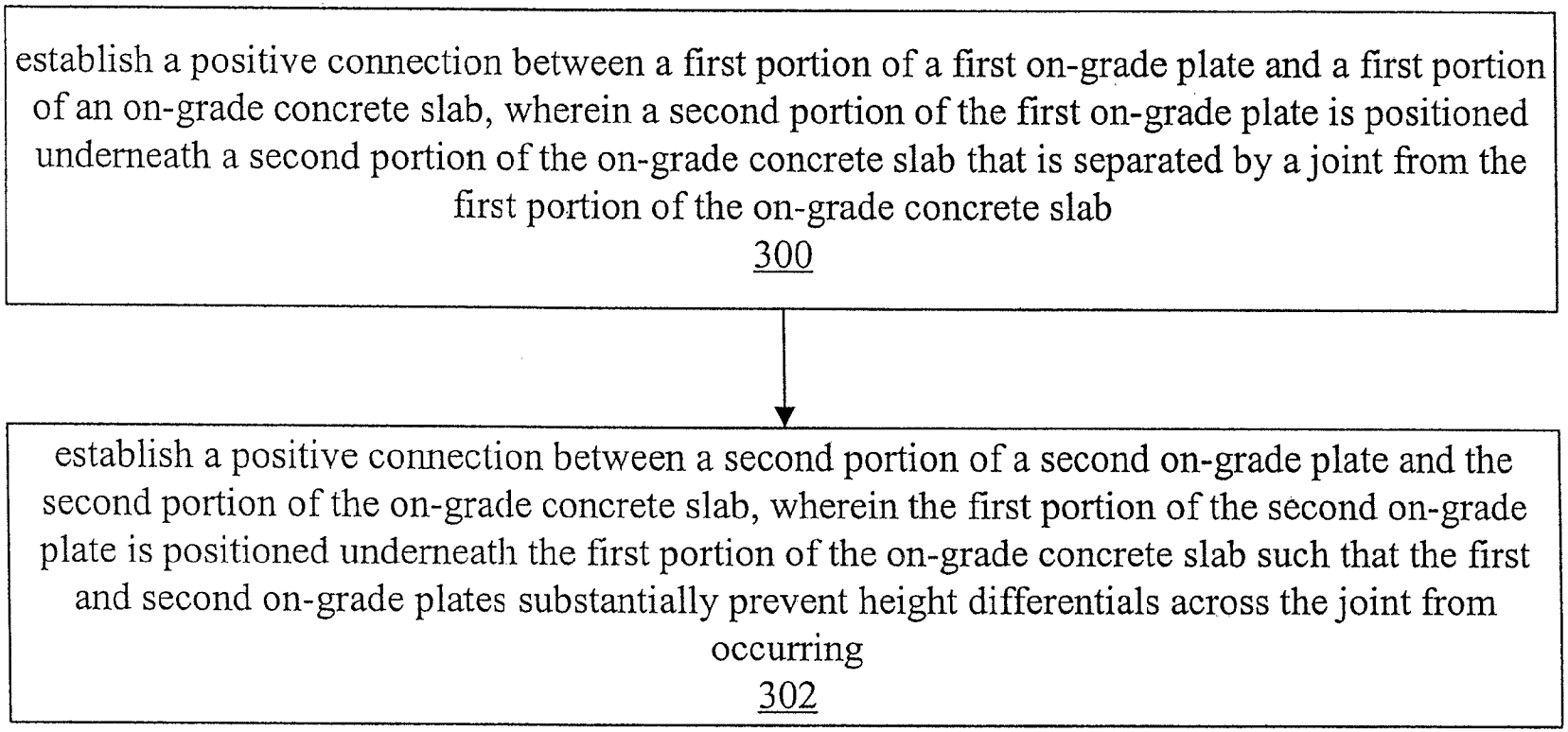
FIGS. 3-7 are flow charts showing steps for stabilizing a joint between on-grade concrete-slab portions in accordance with embodiments of the invention.

In the following description of the various embodiments, reference is made to the accompanying drawings, which form a part hereof, and in which are shown, by way of illustration, various embodiments of the invention. Other embodiments may be utilized and structural and functional modifications may be made without departing from the scope and spirit of the present invention.

Load plates of the type disclosed in the issued U.S. patent and the published international patent application discussed above are well suited to transferring loads between load-bearing concrete slabs that are at least approximately 6 inches deep. The phrase "load-bearing slabs" refers to floors designed to accommodate fork lifts and other relatively heavy loads.

For situations in which load transfer is not required, such as, sidewalks, malls, and in stores in which forklifts do not ride along the floor, shallow floor slabs, for instance, floor slabs that are less than approximately five inches deep, are typically used.

Although load transfer may not be needed, joints between shallow floor slabs should be stabilized to prevent adjacent slabs from developing height differentials relative to one another. Height differentials of this type are tripping hazards, which may undesirably cause people to trip, fall, get injured, and initiate related personal-injury litigation.

Slabs can curl due to differential shrinkage throughout the slabs depth. Different lengths curl more or less. In saw-cut joints, this curling of slabs occurs. Joint stability (i.e., preventing differential vertical movement between adjacent slabs) is desirable so that the slabs curl together.

If concrete floor slabs are shallow, for instance less than approximately five inches deep, concrete may not consolidate (i.e., fill in void spaces) as desired if conventional plate arrangements, such as those disclosed in the issued U.S. patent and the published international patent application discussed above, are used. Aggregate used in concrete is measured according to the smallest dimension of the particle. For example, a three-quarter inch aggregate may, in fact, be three-quarter inch in width, but substantially larger in length, e.g., 1.25 inches. Particles of such size below a conventional load plate located at the mid-depth of the slab may cause voids to occur below the plates when the slab thickness is less than approximately five inches. Conventional plate arrangements may be used, however, when the slab thickness is at least six inches, such as floors that are designed to handle use of forklifts.

Moreover, slabs having a specified height of four inches may actually be only 3.25" deep in particular places due to tolerances in the level of the subgrade. Based on the considerations discussed above, using plates located halfway up the height of the slabs is associated with various shortcomings.

Embodiments of the invention are directed to on-grade plates for use with on-grade concrete slabs less than approximately five inches deep for the purpose of insuring joint stability rather than for traditional load-transfer functionality. "On-grade concrete slabs," as used herein, refers to concrete slabs placed on a subgrade and/or a subbase. The subgrade is the natural in-place soil. The subbase is generally a compactible fill material that brings the surface to a desired grade.

In accordance with embodiments of the invention, trapezoidal plates may be situated on the subgrade or subbase. Plates having other shapes, including, but not limited to, a circle or a rectangle, may also be used. Plates may be triangular shaped. A pointed end may, however, present a safety hazard and may produce undesirable stress concentrations. Therefore, the pointed end may be omitted such that the plate takes on a generally trapezoidal shape.

The plates permit substantially full consolidation of the concrete slab for slab thicknesses down to approximately four inches deep. If such a plate is at grade with a 4" slab, it produces a situation above the plates that is similar to an 8" slab with plates embedded at a height of 4". In this way, plates in accordance with embodiments of the invention avoid under-consolidation of concrete beneath the plate and spalling of concrete above the plate as may happen if the concrete cover above the plate is too thin.

The wide end of the trapezoidal plate may have either a stirrup or stud protruding into a concrete-slab portion to create a positive connection between the plate and the concrete-slab portion. The plates may be situated in an alternating fashion such that each successive plate is rotated 180 degrees relative to its neighboring plates. For instance, referring to FIG. 2, plate 106-1 has its wide end oriented to the left, plate 106-2 has its wide end oriented to the right, and plate 106-3 has its wide end oriented to the left. As is discussed in more detail below, alternating the orientation of the plates in such a way operates to prevent height differentials across joints between slab portions thereby preventing a trip hazard despite movement of the slabs due to slabs settling, shrinking, crowning, and the like.

On-grade plates oriented alternately work together to prevent height differentials between adjacent concrete slabs as follows. Referring to FIGS. 1 and 2, slab portions 100-1 and 100-2 are cast in place and divided via saw cut 102 and crack 104. Plates 106-1 and 106-3 are positioned such that they will be positively connected, via their respective stirrups 108-1 and 108-3, to slab portion 100-1. Similarly, plate 106-2 is positioned such that it will be positively connected, via its stirrup 108-2, to slab portion 100-2. Although not shown in FIG. 2, additional on-ground plates 106 may be oriented in alternating directions (as is the case with plates 106-1, 106-2, and 106-3) at a joint between slab portions.

If slab-portion 100-1 moves upward, then the plates 106-1, 106-3, and any additional plates oriented the same way, underneath slab portion 100-1 will be lifted via the positive connection established by stirrups 108-1 and 108-3 between plates 106-1 and 106-3 and slab-portion 100-1. Lifting of the plates in this way will result in the respective portions of the plates 106-1, 106-3, and any additional plates oriented the same way, that are positioned underneath slab portion 100-2 to lift slab portion 100-2 thereby preventing a height differential across the saw cut 102.

If slab-portion 100-1 moves downward, then the portion of plate 106-2, and any additional plates oriented the same way, underneath slab portion 100-1 will be pushed down. This will cause slab portion 100-2 to be pulled down through the stirrup on plate 106-2 (and through the stirrups on other plates oriented in generally the same direction) thereby preventing a height differential across the saw cut 102.

The principles discussed above with respect to preventing height differentials across saw cut 102 apply to upward and downward movement of slab-portion 100-2. Namely, if slab-portion 100-2 moves upward, then the portion of plate 106-2, and any additional plates oriented in generally the same direction, underneath slab portion 100-1 will lift slab portion 100-1 thereby preventing a height differential across the saw cut 102.

If slab-portion 100-2 moves downward, then the portion of plates 106-1, 106-3, and any additional plates oriented the same way, underneath slab portion 100-2 will be pushed down. This will cause slab portion 100-1 to be pulled down through the respective stirrups 108-1 and 108-3 on plates 106-1 and 106-3 (and through the stirrups of other plates oriented across saw cut 102 in generally the same direction as plates 106-1 and 106-3) thereby preventing a height differential across the saw cut 102.

Instead of (or in addition to) a stirrup 108, other means for positively connecting a plate 106 to a slab portion 100 may be used. For example, a headed stud that protrudes from the plate at a location relatively close to the saw cut may be used.

In accordance with embodiments of the invention, a blockout sheath with foam or fins inside of the blockout sheath may be used to create voids to the sides of the plates. Techniques of this type are well known in the art, are discussed in the issued U.S. patent mentioned above, and, therefore, do not need to be discussed herein in detail.

The plates may be made of steel or any other suitable material. To prevent corrosion, an epoxy coating may be applied to the plates and/or a vapor barrier may be used under the slabs.

FIGS. 3-7 are flow charts showing steps for stabilizing a joint between concrete on-grade slabs in accordance with embodiments of the invention. Referring to FIG. 3, a positive connection between a first portion of a first on-grade plate and a first portion of an on-grade concrete slab is established, wherein a second portion of the first on-grade plate is positioned underneath a second portion of the on-grade concrete slab that is separated by a joint from the first portion of the on-grade concrete slab, as shown at 300. A positive connection between a second portion of a second on-grade plate and the second portion of the on-grade concrete slab is established, wherein the first portion of the second on-grade plate is positioned underneath the first portion of the on-grade concrete slab such that the first and second on-grade plates substantially prevent height differentials across the joint from occurring, as shown at 302.

Figure 4:
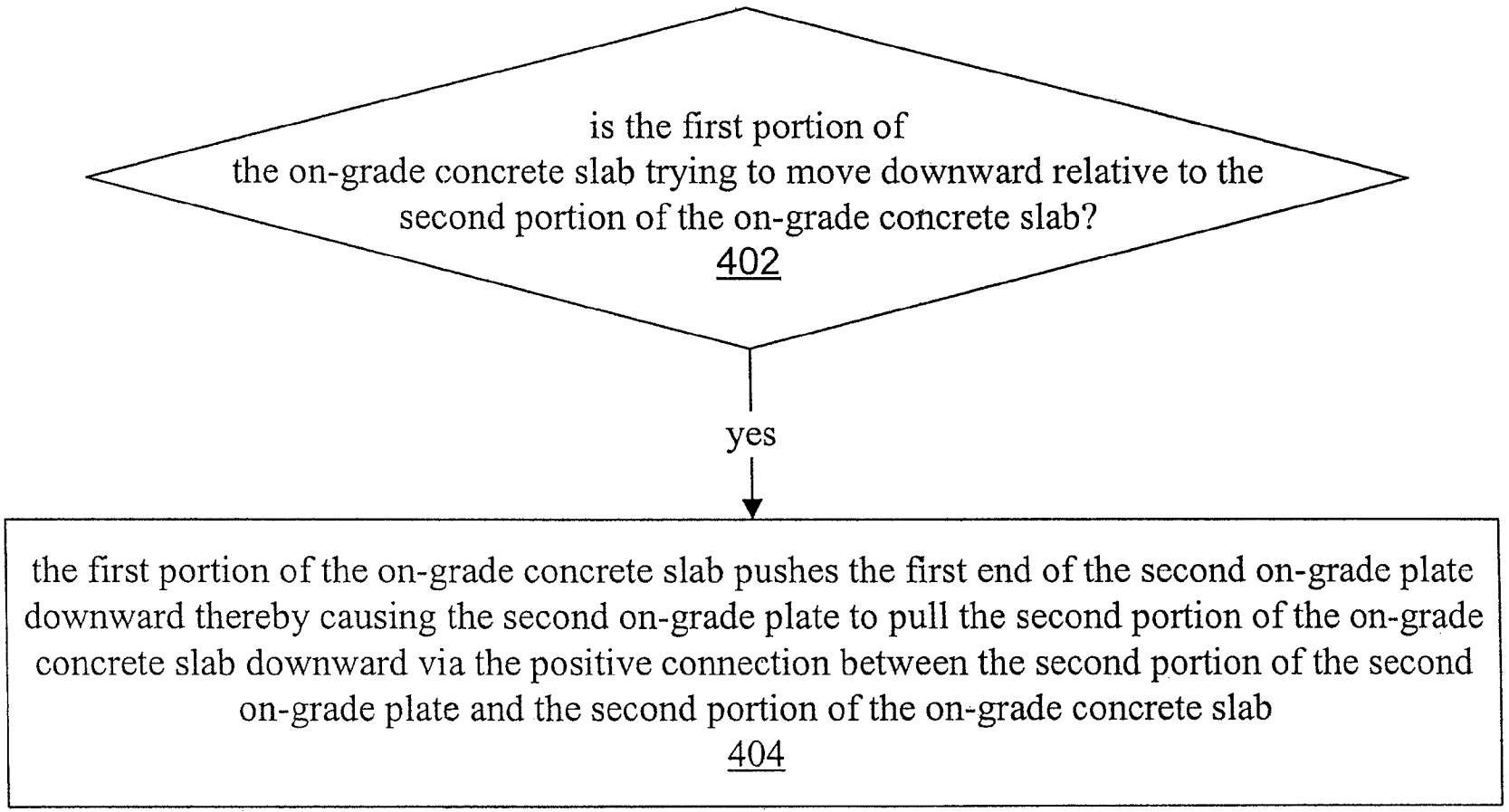

Referring to FIG. 4, if the first portion of the on-grade concrete slab is trying to move downward relative to the second portion of the on-grade concrete slab, the yes arrow will be followed, as shown at 402. Then, the first portion of the on-grade concrete slab pushes the first end of the second on-grade plate downward thereby causing the second on-grade plate to pull the second portion of the on-grade concrete slab downward via the positive connection between the second portion of the second on-grade plate and the second portion of the on-grade concrete slab, as shown at 404.

Figure 5:
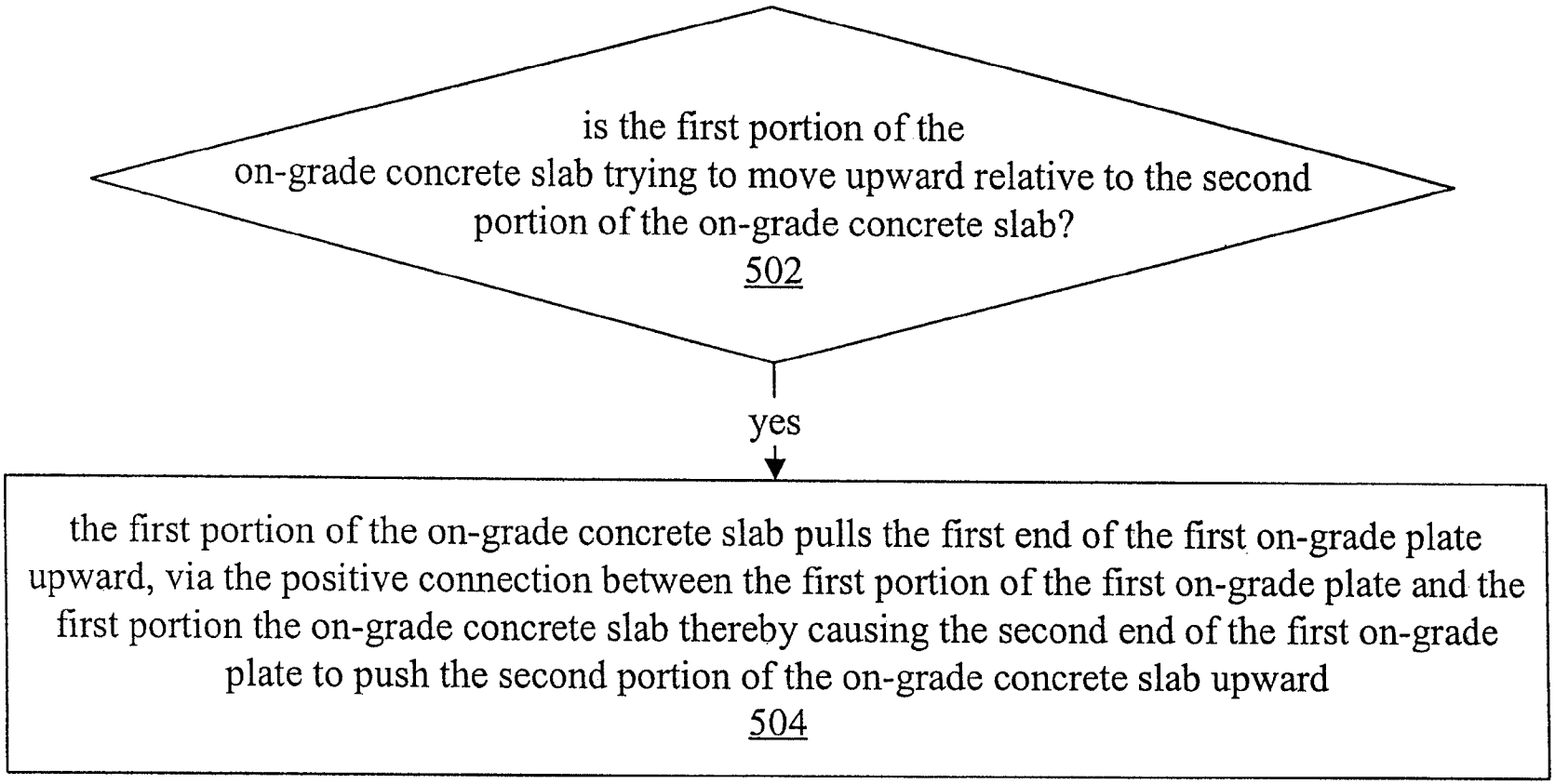

Referring to FIG. 5, if the first portion of the on-grade concrete slab is trying to move upward relative to the second portion of the on-grade concrete slab, the yes arrow will be followed, as shown at 502. Then, the first portion of the on-grade concrete slab pulls the first end of the first on-grade plate upward, via the positive connection between the first portion of the first on-grade plate and the first portion the on-grade concrete slab thereby causing the second end of the first on-grade plate to push the second portion of the on-grade concrete slab upward, as shown at 504.

Figure 6:
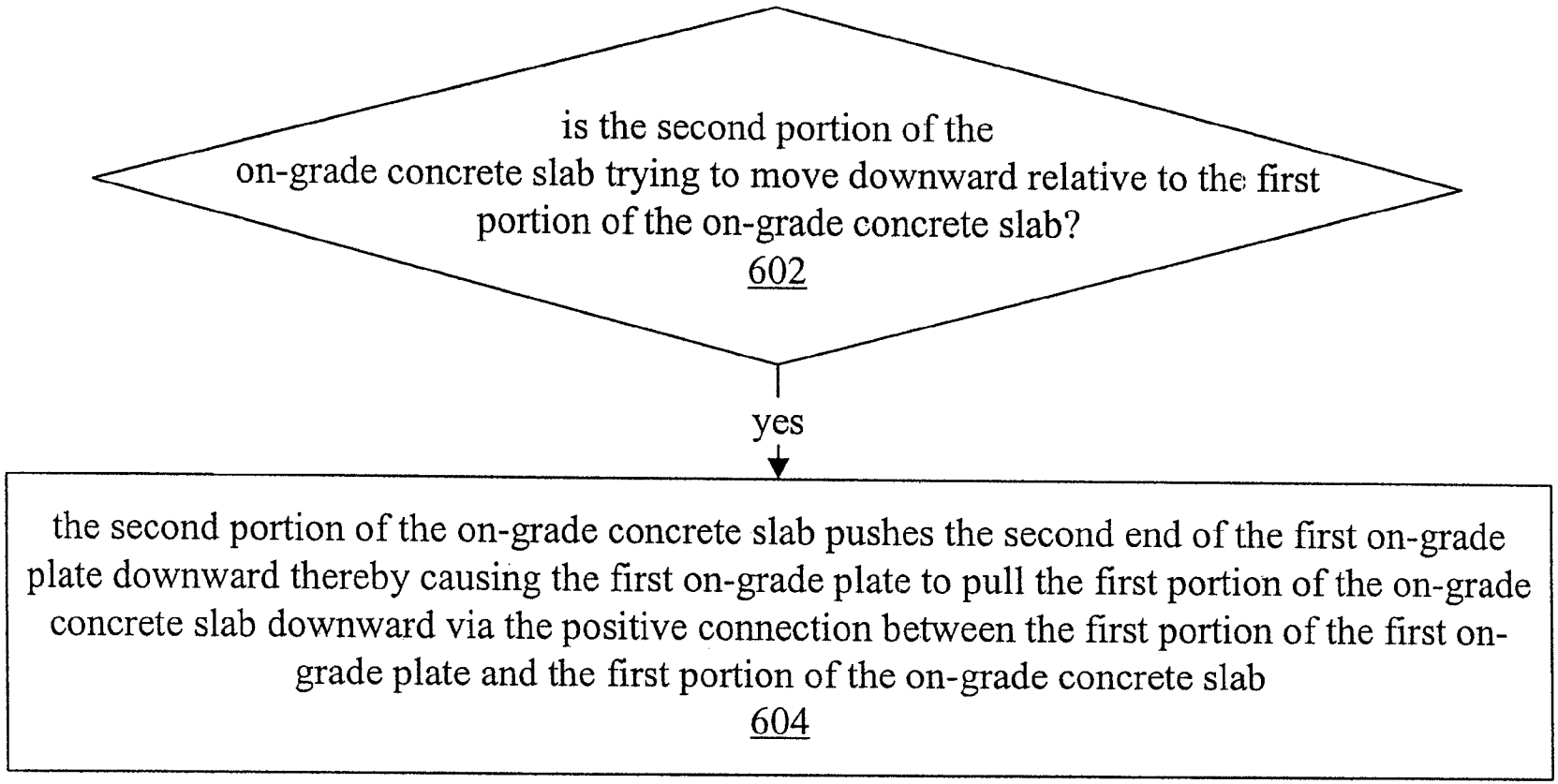

Referring to FIG. 6, if the second portion of the on-grade concrete slab is trying to move downward relative to the first portion of the on-grade concrete slab, the yes arrow will be followed, as shown at 602. Then, the second portion of the on-grade concrete slab pushes the second end of the first on-grade plate downward thereby causing the first on-grade plate to pull the first portion of the on-grade concrete slab downward via the positive connection between the first portion of the first on-grade plate and the first portion of the on-grade concrete slab, as shown at 604.

Figure 7:
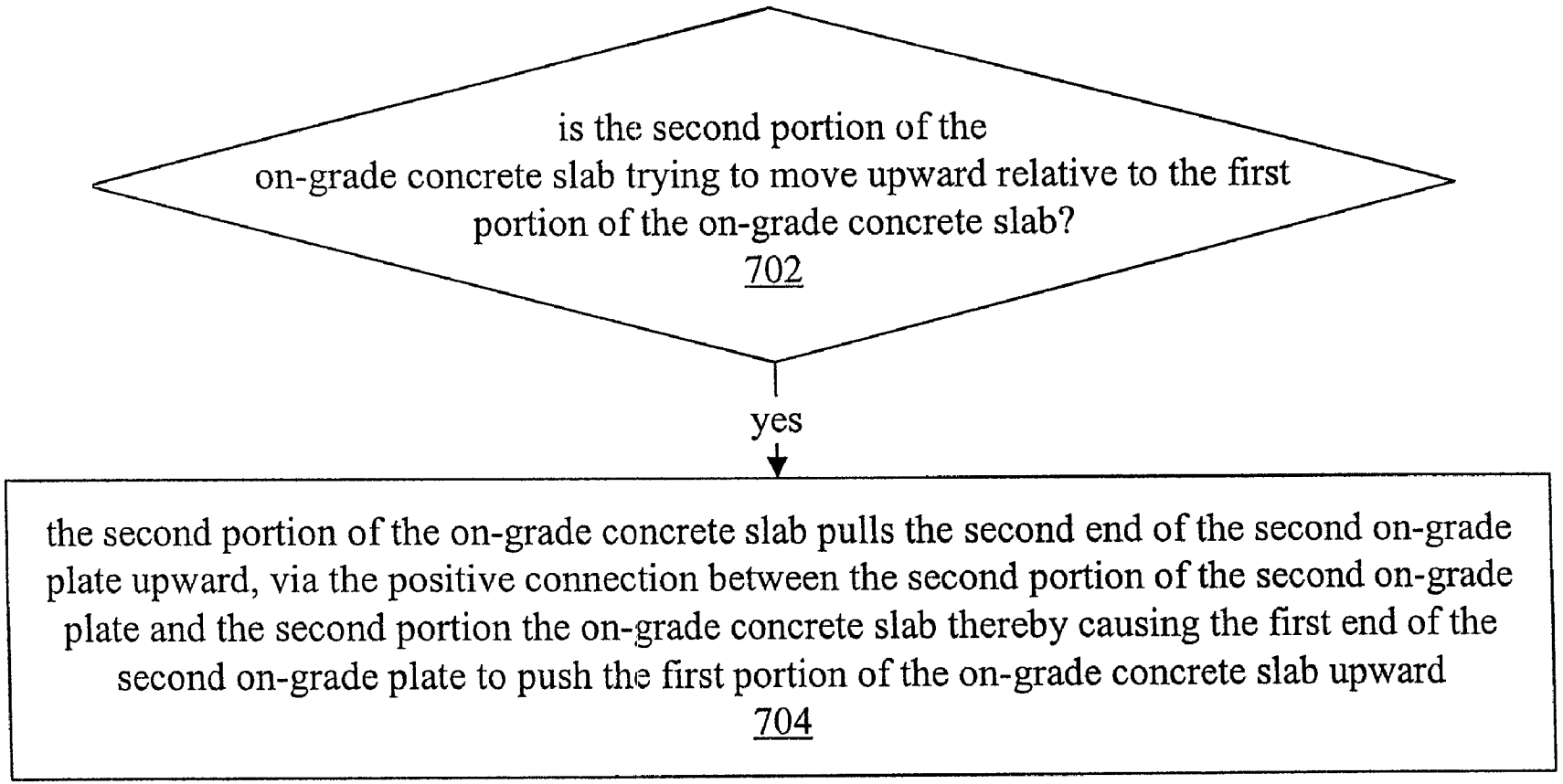

Referring to FIG. 7, if the second portion of the on-grade concrete slab is trying to move upward relative to the first portion of the on-grade concrete slab, the yes arrow will be followed, as shown at 702. Then, the second portion of the on-grade concrete slab pulls the second end of the second on-grade plate upward, via the positive connection between the second portion of the second on-grade plate and the second portion the on-grade concrete slab thereby causing the first end of the second on-grade plate to push the first portion of the on-grade concrete slab upward, as shown at 704.

Although the subject matter has been described in language specific to structural features and/or methodological acts, the subject matter defined in the appended claims is not necessarily limited to the specific features or acts described above. Rather, the specific features and acts described above are disclosed as example forms of implementing the claims.

We claim:

1. An on-grade joint-stability system for substantially restricting relative vertical movement of on-grade concrete-slab portions that meet at a joint that does not require load transfer, the system comprising:

a first on-grade concrete-slab portion;

a second on-grade concrete-slab portion that meets the first on-grade concrete-slab portion at the joint;

multiple, separate first on-grade plates each having a first portion and a second portion, the first portion of each first on-grade plate being positioned underneath, and connected to, in opposition to vertical separation from, the first concrete-slab portion, and the second portion of each first on-grade plate being positioned underneath the second concrete-slab portion; and multiple, separate second on-grade plates each having a first portion and a second portion, the first portion of each second on-grade plate being positioned underneath the first concrete-slab portion, and the second portion of each second on-grade plate being positioned underneath, and connected to, in opposition to vertical separation from, the second concrete-slab portion;

the first and second on-grade plates having portions, positions and connections as described such that through such portions, positions and connections the first and second on-grade plates substantially restrict relative vertical movement of the first and second on-grade concrete-slab portions that would otherwise result in a height differential across the joint between the first and second on-grade concrete-slab portions;

wherein a substantial quantity of the first and second on-grade plates are tapered such that such plates each have a relatively wider end and a relatively narrower end, and adjacent the joint, have a portion with a gradually decreasing width.

2. The system of claim 1, wherein the joint comprises at least one of a saw cut and a crack between the first and second on-grade concrete-slab portions.

3. The system of claim 1, wherein the first and second on-grade concrete-slab portions are less than approximately five inches deep.

4. The system of claim 1, wherein the first and second on-grade plates are tapered such that the plates each have a width that gradually tapers along the extent of the plates between the relatively wider end and a relatively narrower end.

5. The system of claim 4, wherein the relatively wider ends of the first on-grade plates comprise at least one of a stirrup and a stud for positively connecting the first on-grade plate to the first on-grade concrete slab.

6. The system of claim 5, wherein the relatively wider ends of the second on-grade plates comprise at least one of a stirrup and a stud for positively connecting the second on-grade plate to the second on-grade concrete-slab portion.

7. The system of claim 4, wherein the first and second on-grade plates are generally trapezoidal shaped.

8. The system of claim 4, wherein the first and second on-grade plates are generally triangular shaped.

9. The system of claim 1, wherein the first and second on-grade plates are oriented such that for a range of joint opening dimensions, reduced width of the first plates at the joint due to plate taper is compensated for by increased width of the second plates due to plate taper.

10. The system of claim 1, wherein: the joint comprises at least one of a saw cut and a crack between the first and second on-grade concrete-slab portions; the first and second on-grade concrete-slab portions are less than approximately five inches deep; the first and second on-grade plates are tapered such that the plates each have a width that gradually tapers along the extent of the plates between the relatively wider end and a relatively narrower end; the relatively wider ends of the first on-grade plates comprise at least one of a stirrup and a stud for positively connecting the first on-grade plate to the first on-grade concrete slab; the relatively wider ends of the second on-grade plates comprise at least one of a stirrup and a stud for positively connecting the second on-grade plate to the second on-grade concrete-slab portion; the first and second on-grade plates are generally trapezoidal shaped; and the first and second on-grade plates are oriented such that for a range of joint opening dimensions, reduced width of the first plates at the joint due to plate taper is compensated for by increased width of the second plates due to plate taper.

11. A method of stabilizing a joint for substantially restricting relative vertical movement of on-grade concrete slab portions that meet at a joint that does not require load transfer, the method comprising:

establishing a positive connection between first portions of multiple, separate first on-grade plates and a first portion of an on-grade concrete slab, in opposition to vertical separation therefrom, wherein second portions of the first on-grade plates are positioned underneath a second portion of the on-grade concrete slab that meets the first portion of the on-grade concrete slab at a joint; and establishing a positive connection between second portions of multiple, separate second on-grade plates and the second portion of the on-grade concrete slab, in opposition to vertical separation therefrom, wherein the first portions of the second on-grade plates are positioned underneath the first portion of the on-grade concrete slab;

the establishment of the connections and positions as described being such that through such connections and positions, the first and second on-grade plates substantially prevent height differentials across the joint from occurring; and establishing the connections and positions as described with a substantial quantity of the first and second on-grade plates being tapered such that such plates each have a relatively wider end and a relatively narrower end, and adjacent the joint, have a portion with a gradually decreasing width.

12. The method of claim 11, wherein, if the first portion of the on-grade concrete slab tries to move downward relative to the second portion of the on-grade concrete slab, the first portion of the on-grade concrete slab pushes the first end of the second on-grade plates downward thereby causing the second on-grade plates to pull the second portion of the on-grade concrete slab downward via the positive connection between the second portion of the second on-grade plates and the second portion of the on-grade concrete slab.

13. The method of claim 12, wherein, if the first portion of the on-grade concrete slab tries to move upward relative to the second portion of the on-grade concrete slab, the first portion of the on-grade concrete slab pulls the first end of the first on-grade plates upward, via the positive connection between the first portion of the first on-grade plates and the first portion the on-grade concrete slab thereby causing the second end of the first on-grade plates to push the second portion of the on-grade concrete slab upward.

14. The method of claim 13, wherein, if the second portion of the on-grade concrete slab tries to move downward relative to the first portion of the on-grade concrete slab, the second portion of the on-grade concrete slab pushes the second end of the first on-grade plates downward thereby causing the first on-grade plates to pull the first portion of the on-grade concrete slab downward via the positive connection between the first portion of the first on-grade plates and the first portion of the on-grade concrete slab.

15. The method of claim 14, wherein, if the second portion of the on-grade concrete slab tries to move upward relative to the first portion of the on-grade concrete slab, the second portion of the on-grade concrete slab pulls the second end of the second on-grade plates upward, via the positive connection between the second portion of the second on-grade plates and the second portion the on-grade concrete slab thereby causing the first end of the second on-grade plates to push the first portion of the on-grade concrete slab upward.

16. The method of claim 11, wherein the first and second on-grade plates are oriented such that for a range of joint opening dimensions, reduced width of the first plates at the joint due to plate taper is compensated for by increased width of the second plates due to plate taper.

17. For use in creating an on-grade joint-stability system for substantially restricting relative vertical movement of on-grade concrete-slab portions that meet at a joint that does not require load transfer, the on-grade concrete-slab portions including portions, panels and slabs poured independently of each other and portions poured together as one slab and then separated into portions, panels or slabs, and the on-grade slab portions including a first on-grade concrete-slab portion, and a second on-grade concrete-slab portion that meets the first on-grade concrete-slab portion at the joint, apparatus comprising:

multiple, separate first on-grade plates each having a first portion and a second portion, the first portion of the first on-grade plates being positioned underneath, and connected to, in opposition to vertical separation therefrom, the first concrete-slab portion, and the second portion of the first on-grade plates being positioned underneath the second concrete-slab portion; and multiple, separate second on-grade plates each having a first portion and a second portion, the first portion of the second on-grade plates being positioned underneath the first concrete-slab portion, and the second portion of the second on-grade plates being positioned underneath, and connected to, in opposition to vertical separation therefrom, the second concrete-slab portion;

the first and second on-grade plates having portions, positions and connections as described such that through such portions, positions and connections the first and second on-grade plates substantially restrict relative vertical movement of the first and second on-grade concrete-slab portions that would otherwise result in a height differential across the joint between the first and second on-grade concrete-slab portions; and wherein a substantial quantity of the first and second on-grade plates are tapered such that the plates each have a relatively wider end and a relatively narrower end, and adjacent the joint, have a portion with a gradually decreasing width.

18. The apparatus of claim 17, wherein the first and second on-grade plates are oriented such that for a range of joint opening dimensions, reduced width of the first plates at the joint due to plate taper is compensated for by increased width of the second plates due to plate taper.

19. For use in creating an on-grade joint-stability system for substantially restricting relative vertical movement of on-grade concrete-slab portions that meet at a joint, the on-grade concrete-slab portions including portions, panels and slabs poured independently of each other and portions poured together as one slab and then separated into portions, panels or slabs, and the on-grade slab portions including a first on-grade concrete-slab portion, and a second on-grade concrete-slab portion that meets the first on-grade concrete-slab portion at the joint, apparatus comprising:

multiple, separate first on-grade plates each having a first portion and a second portion, the first portion of the first on-grade plates constructed and arranged to be positioned underneath, and connected to, in opposition to vertical separation therefrom, the first concrete-slab portion, and the second portion of the first on-grade plates being constructed and arranged to be positioned underneath the second concrete-slab portion; and multiple, separate second on-grade plates each having a first portion and a second portion, the first portion of the second on-grade plates being constructed and arranged to be positioned underneath the first concrete-slab portion, and the second portion of the second on-grade plates being constructed and arranged to be positioned underneath, and connected to, in opposition to vertical separation therefrom, the second concrete-slab portion;

the first and second on-grade plates having portions, positions and connections as described such that when the first and second on-grade plates are positioned as described, then through such portions, positions and connections the first and second on-grade plates substantially restrict relative vertical movement of the first and second on-grade concrete-slab portions that would otherwise result in a height differential across the joint between the first and second on-grade concrete-slab portions;

wherein the first and second on-grade plates are tapered such that the plates each have a relatively wider end and a relatively narrower end, and adjacent the joint, have a portion with a gradually decreasing width.

20. The apparatus of claim 19, wherein the first and second on-grade plates are oriented such that for a range of joint opening dimensions, reduced width of the first plates at the joint due to plate taper is compensated for by increased width of the second plates due to plate taper.

* * * * *